US005548499A

United States Patent [19]

Zadeh

[11] Patent Number: 5,548,499

[45] Date of Patent: Aug. 20, 1996

[54] LIGHT FIXTURE FOR RECESS IN SLOPED CEILING

[75] Inventor: Rohollah E. Zadeh, Los Angeles, Calif.

[73] Assignee: AMP Plus, Inc., Culver City, Calif.

[21] Appl. No.: 294,109

[22] Filed: Aug. 19, 1994

[51] Int. Cl.[6] ..... F21S 1/02

[52] U.S. Cl. ..... 362/366; 362/147; 362/365; 362/372

[58] Field of Search ..... 362/147, 148, 362/269, 287, 364, 365, 366, 372, 371, 427, 370

[56] References Cited

U.S. PATENT DOCUMENTS 3,609,346 9/1971 Lund et al. ..... 362/364
4,745,533 5/1988 Smerz ..... 362/364
4,947,297 8/1990 Druffel et al. ..... 362/364
5,130,914 7/1992 Bengochea ..... 362/365

*Primary Examiner*—Denise L. Gromada
*Assistant Examiner*—Y. Quach
*Attorney, Agent, or Firm*—Beehler & Pavitt

[57] ABSTRACT

A lighting fixture for insertion in a cylindrical housing disposed in an opening in a slanted ceiling, the fixture including an inner housing removably suspended within the outer housing, and means within the inner housing to pivot a downwardly projecting lamp inserted in a base connected by wiring to a power source and disposed within the inner housing, so that the direction of the lamp's illumination may be varied within the inner housing.

4 Claims, 6 Drawing Sheets

LIGHT FIXTURE FOR RECESS IN SLOPED CEILING

FIELD OF THE INVENTION

This invention relates to the field of electrical lighting fixtures and, particularly, to the type of fixture which is mounted in a recess in a sloping ceiling.

BACKGROUND OF THE INVENTION

It is commonly found to be desirable to provide recessed lighting fixtures in inclined or sloped ceilings. Illustrative of the type of fixtures which have been proposed is that illustrated and described in U.S. Pat. No. 4,729,080. In this patent, a conically flared-out incandescent lamp is threaded into a socket mounted inside the top of a cylindrical housing. The head of the lamp is surrounded by a baffle which extends downwardly below the lamp to the ceiling with its lower end terminating at an angle relative to the housing axis, which angle coincides with the slope angle of the ceiling. The purpose of this extended baffle is to absorb light and eliminate glare, with the light being directed downwardly along the axis of the cylindrical housing.

A problem with the fixture of this patent is that the angle at which the light is directed into the room space below the ceiling is not variable. In addition, because the baffle extends for a substantial distance between the head of the lamp and the ceiling opening, much of the light which is emanated from the lamp is absorbed by the baffle and never reaches the room space below the ceiling. In addition, the baffle arrangement of the patent presents certain difficulties in mounting the fixture due to the necessity of bringing the two parts of the baffle together, spring clipping them into position and suspending them from the upper housing by tension springs.

What has been needed is a simple fixture which can be slipped into a housing in a sloped ceiling opening with a lamp which can be screwed into a free-wired socket, and the lamp pivotally mounted so that its light may be directed at a plurality of angles relative to the ceiling.

SUMMARY OF THE INVENTION

The present invention is a greatly simplified fixture which may be inserted in a housing projecting upwardly from a sloped ceiling into the plenum space above the ceiling. Such a housing ordinarily would be cylindrical with a removable upper section and a main lower section which extends down to the ceiling and terminates at an angle relative to the ceiling axis which corresponds with the slope of the ceiling. According to the present invention, an inner housing of the same configuration as the outer housing, but of a lesser altitude and smaller diameter, is provided for spring clip mounting within the lower part of the outer housing. A lamp receptacle, such as a socket or a base-receiving plug, which is connected to electrical wiring extending through upper portions of the outer housing, is pivotally mounted within the inner housing by one of several means.

In one embodiment, a first annular element is fixedly secured within the lower portion of the inner housing coaxially with the latter. A second annular element of a diameter to receive the head of a conically flared out lamp is pivotally mounted within the first annular element along a diameter which is parallel to the surface of the ceiling.

In another embodiment, the receptacle may be secured to a support extending transversely of the inner housing, which support may be pivoted between two portions.

The lighting fixture assembly may be put together by first inserting the lamp into the wired receptacle and then pushing the inner housing up into the recess for disposition within the outer housing. Thus assembled, it will be found that the receptacle with the inserted lamp may be moved over a limited angular range to direct its illumination at different areas of the room below the ceiling.

BRIEF DESCRIPTION OF THE DRAWING

In the accompanying drawings.

DESCRIPTION OF THE PREFERRED EMBODIMENTS

Figure 1:
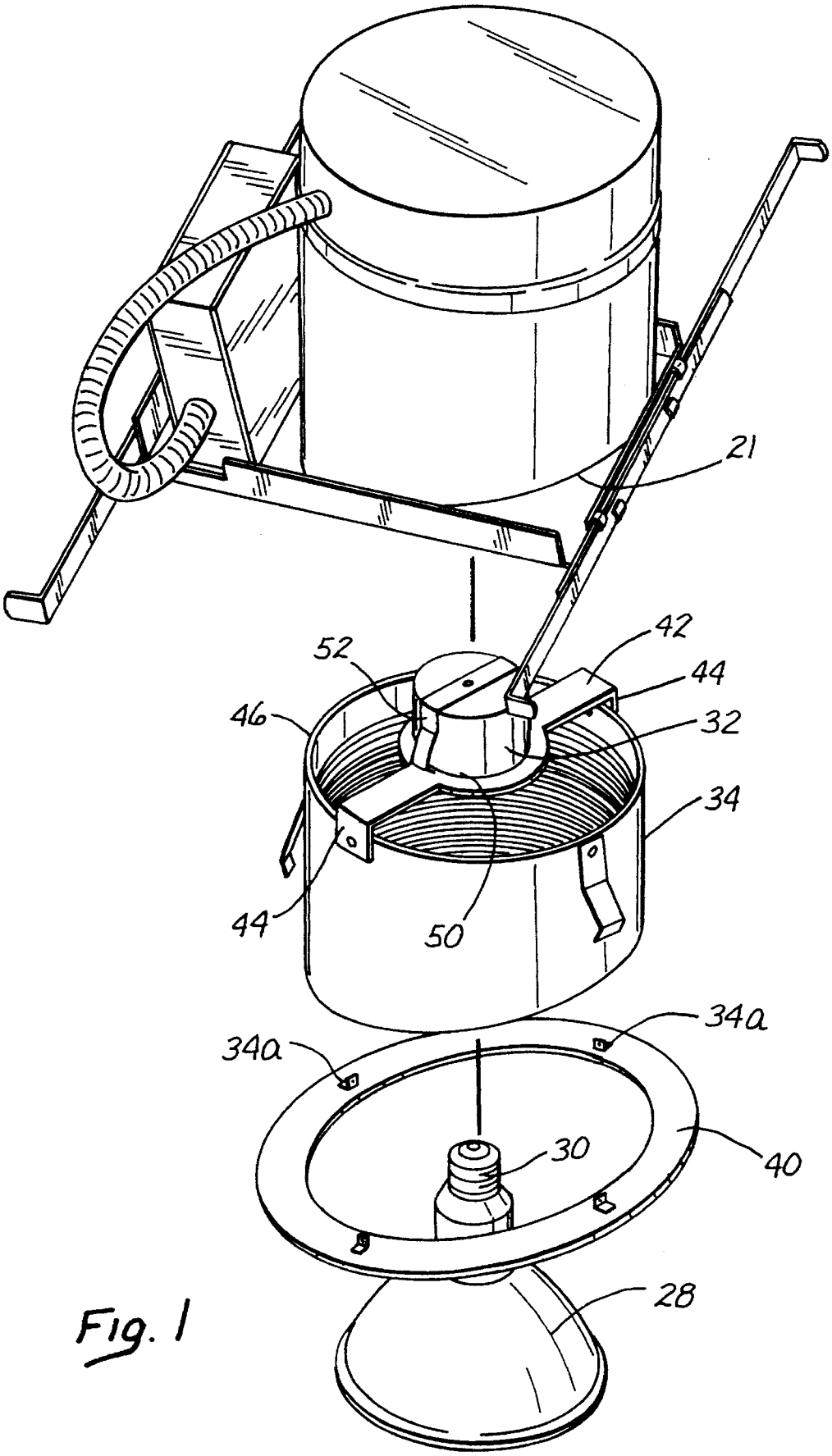
FIG. 1 is an exploded view of a light fixture assembly for a sloped ceiling.
Figure 7A:
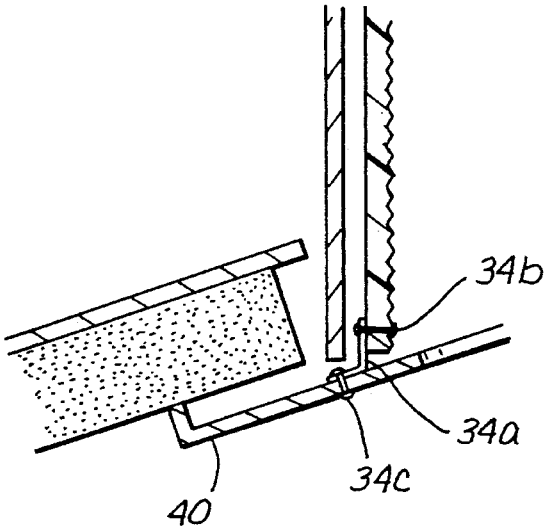
FIG. 7A is an enlarged detail of the area encircled as 7A—7A in FIG. 7.
Figure 2:
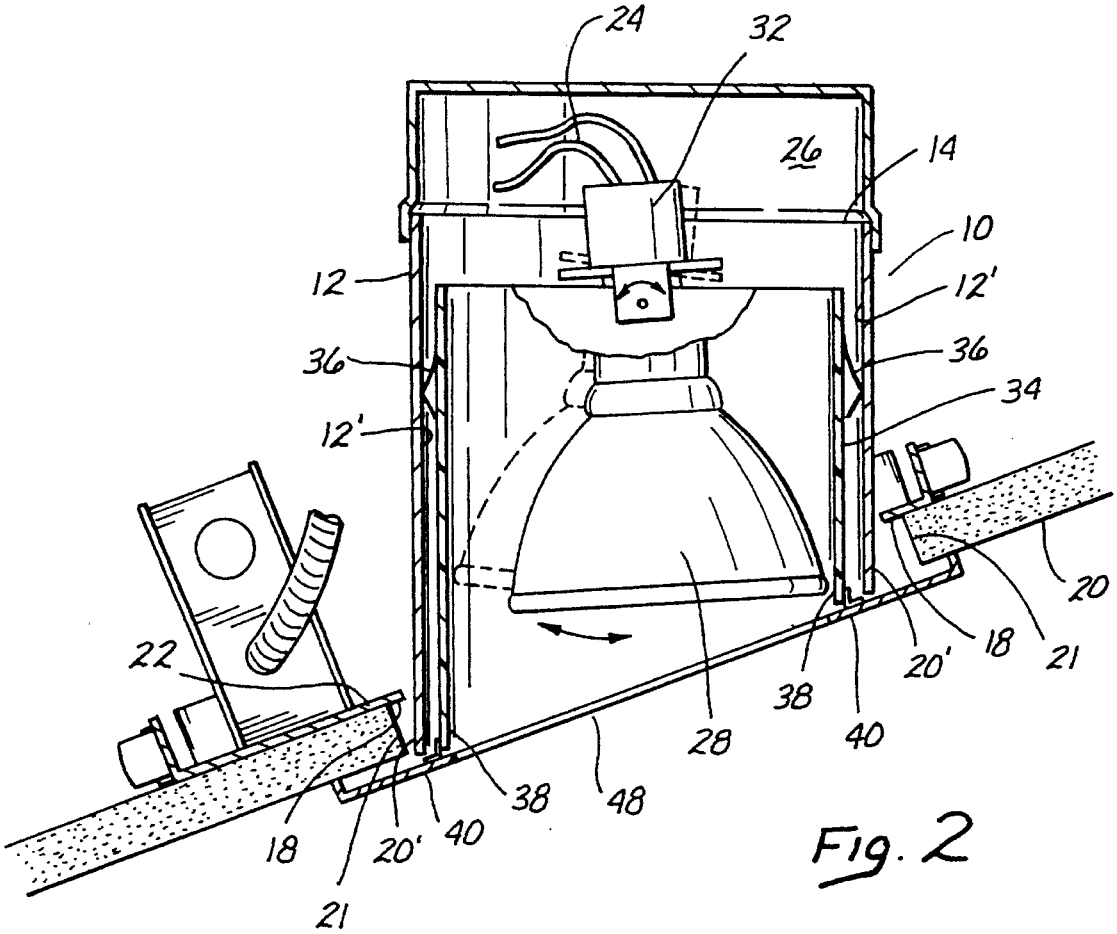
FIG. 2 is a side elevation partly in section showing the components of FIG. 1 mounted in a sloping ceiling.

Referring to FIGS. 1 and 2 of the drawings, the present invention is adopted for installation in a conventional outer housing 10 which comprises a lower cylindrical portion 12, the upper end 14 of which is capped by an upper housing portion 16. The cylindrical portion 12 is open at its lower end which terminates at an angle corresponding to the slope of the ceiling panel 20. The lower end 18 of the outer housing 10 may be provided with a mounting bracket 22 which holds the outer housing 10 about the edges 21 of the ceiling panels 20. Wiring 24 is brought into the upper cavity 26 defined by the upper housing portion 16.

The embodiment of FIGS. 1 and 2 is designed for use with an incandescent lamp 28 which has a threaded base 30 to be screwed into a socket 32 into which the wires 24 carrying the electric current are connected. In this embodiment of FIGS. 1 and 2, an inner housing or baffle 34 is provided for disposition within the outer housing 10. The inner housing 34 is of a lesser altitude dimension than the outer housing 10 and is of a lesser cross sectional diameter so that it may be coaxially disposed within the outer housing portion 10. The inner housing or baffle 34 is shaped congruently with the outer housing portion 10 and is resiliently secured within the inner walls 12' of the outer housing portion 12 by a plurality of spring-like elements 36. the lower edge 38 of the inner housing or baffle 34 has attached to it by angles 34*a* and screws 34*b* and 34*c* of the upper side of a trim ring 40 so that when the installation is complete, the lower edges of the inner housing or baffle 34 are covered by the trim ring 40 and may not be seen below the ceiling.

In the embodiment of the invention illustrated in FIGS. 1 and 2, the socket 32 is mounted on a transverse member, the ends 44 of which are pivotally mounted across the upper edge 46 of the inner housing or baffle 34. Because of this pivotal mounting, it may be seen as shown in phantom in FIG. 2 that the socket 32 and the lamp 28 may be shifted from the solid position to the phantom position by simply reaching in through the opening 48 and moving the lamp 28 in relation to the axis (not shown of the inner housing or baffle 34).

It is also a feature of the present invention that the combination may be easily installed simply by seating the available incandescent lamp socket 32 in the circular portion 50 of the member 42, and securing it in position by a strap 52. The inner housing or baffle will be held in position by the spring-like resilient elements 36 after the inner housing or baffle 34 has been pushed up into the outer housing 12 through the opening 48 until the trim ring 40 abuts the panel or panels 20 defining the ceiling opening 48.

With this installation, it is not only a simple matter to replace a burned out lamp 28 by simply reaching in the opening 48 and unscrewing the bulb and replacing it, but as mentioned above, the direction of the lamp may be varied to the degree shown in phantom in FIG. 2.

Figure 3:
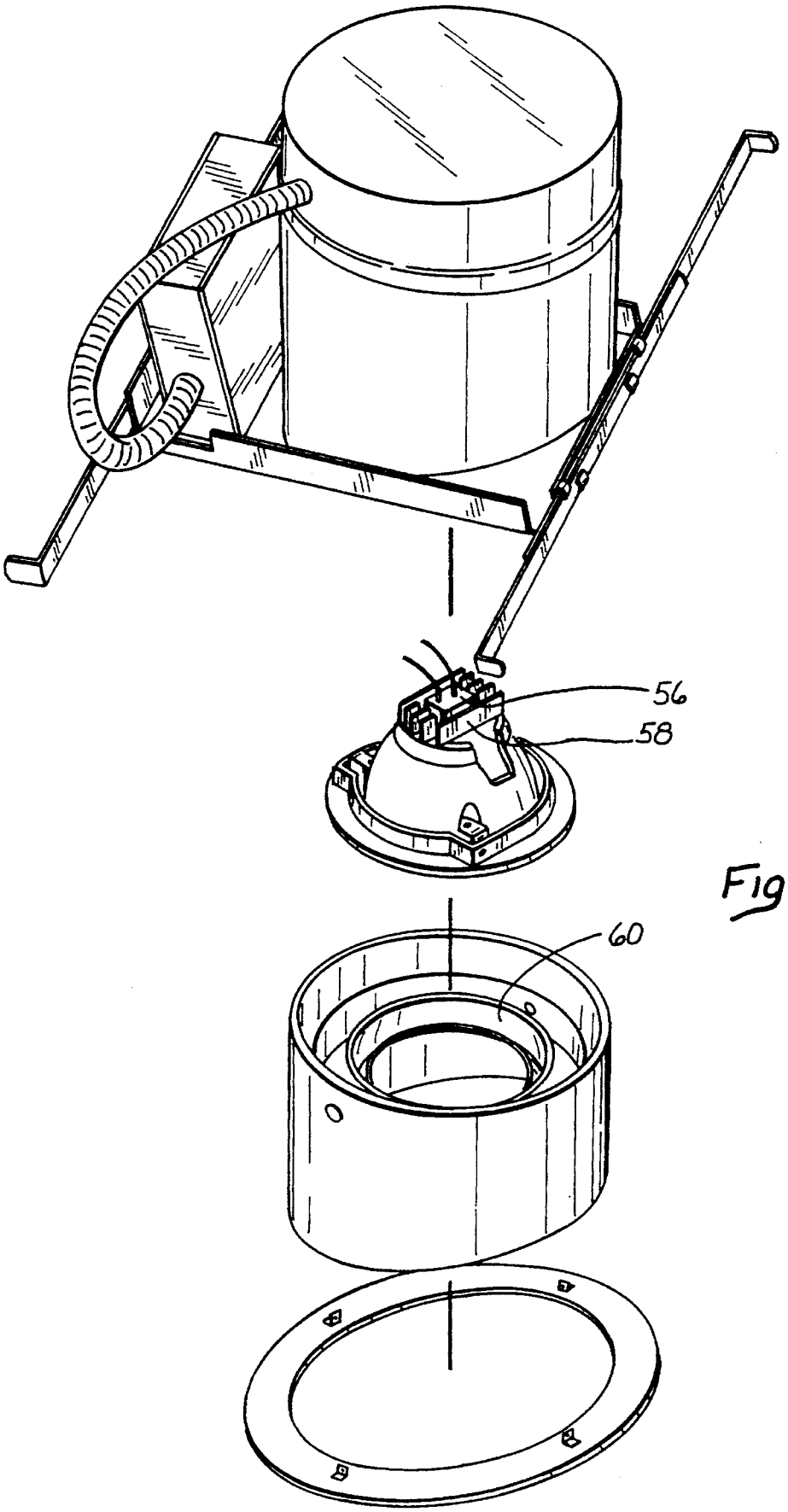
FIG. 3 is a perspective exploded view similar to FIG. 1 illustrating a different embodiment of the invention for a different type of incandescent lamp.
Figure 4:
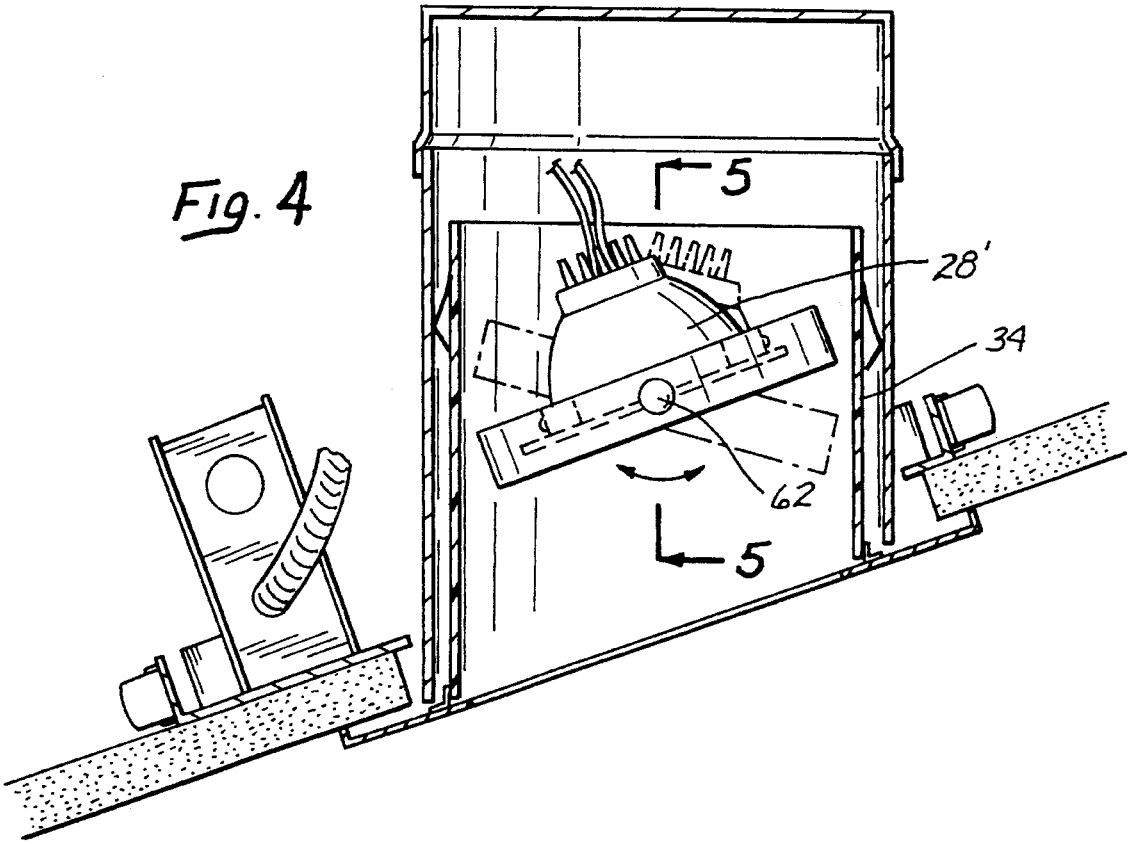
FIG. 4 is an elevation partly in section similar to FIG. 2, but showing the components of FIG. 3 assembled and installed in a sloping ceiling.

The embodiment of FIGS. 3 and 4 differs from that illustrated and described in connection with FIGS. 1 and 2 in the manner in which lamp 28' is pivotally mounted within the inner housing or baffle 34. The lamp 28' of the FIG. 3 and 4 embodiment has a different type of wiring attachment 56, 58. Because this does not lend itself readily to mounting in the manner shown in the FIG. 1 and 2 attachment, the pivotal attachment is accomplished by providing a ring 60 which may be pivotally mounted within the inner housing or baffle 34 by means of elements 62 projecting radially inwardly from the wall of the inner housing 34 within which ring 60 the lamp 28' may be held. With this mounting, the direction of the lamp 28' may be swung between the solid position shown in FIG. 4 and the phantom position.

Figure 5:
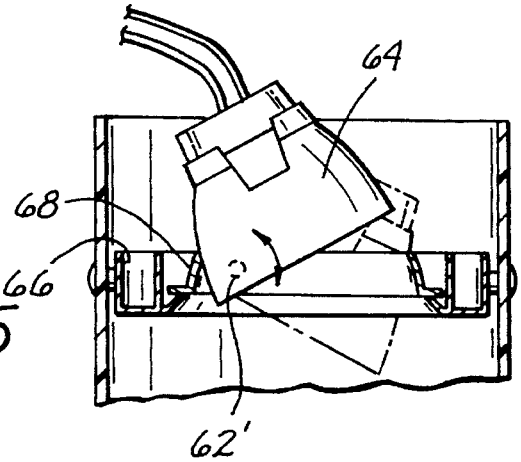
FIG. 5 is a partial elevation illustrating the pivotal mounting of a different type of lamp housing.

In the embodiment of FIG. 5, the pivoting elements 62' are mounted off-center of the particular type of lamp housing 64 shown in this embodiment. In the FIG. 5 embodiment, different annular members 66 and 68 are utilized to support the lamp housing 64.

Figure 6:
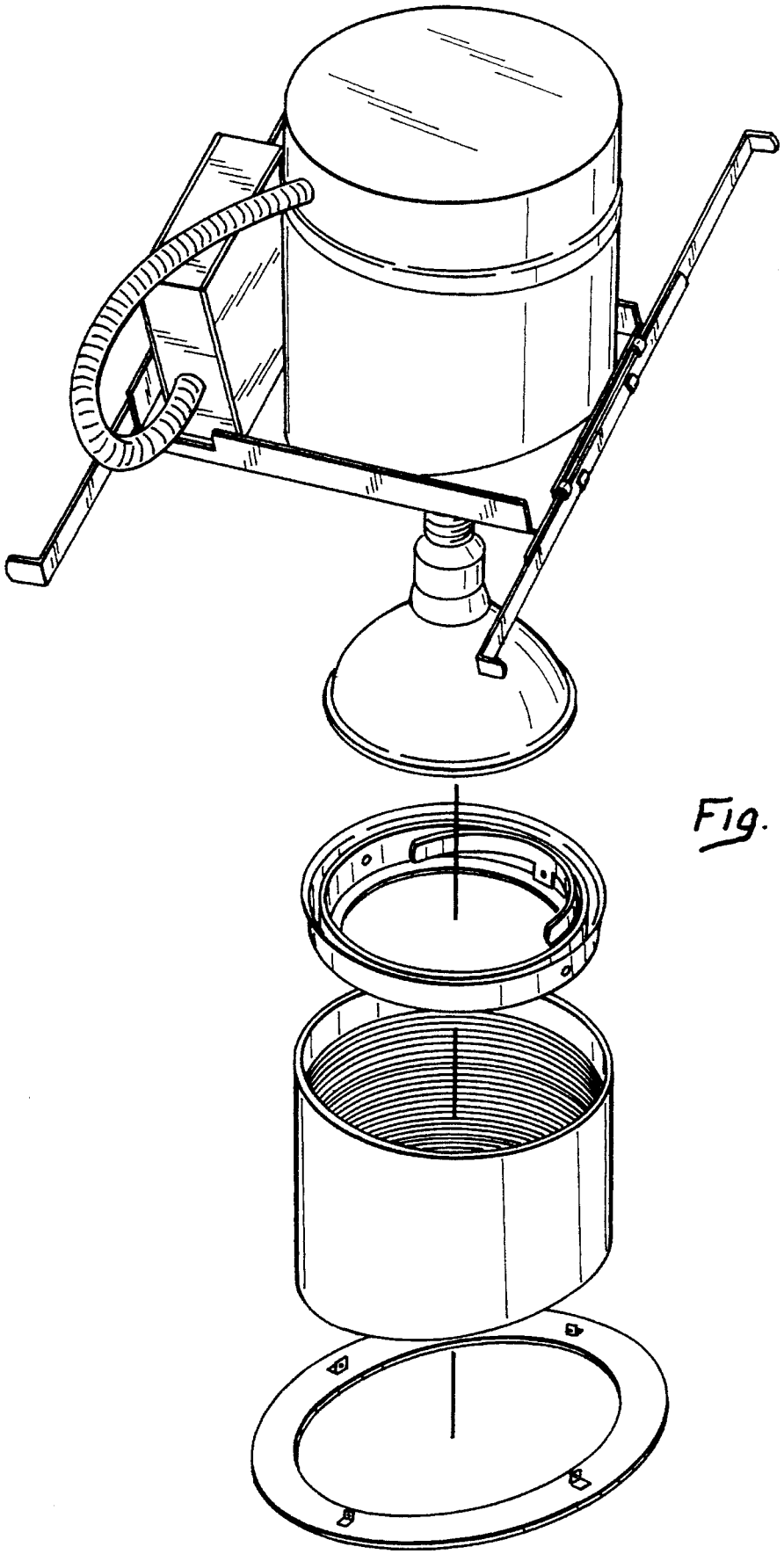
FIG. 6 is an exploded perspective view similar to FIGS. 1 and 3 illustrating a still different embodiment of the invention.
Figure 7:
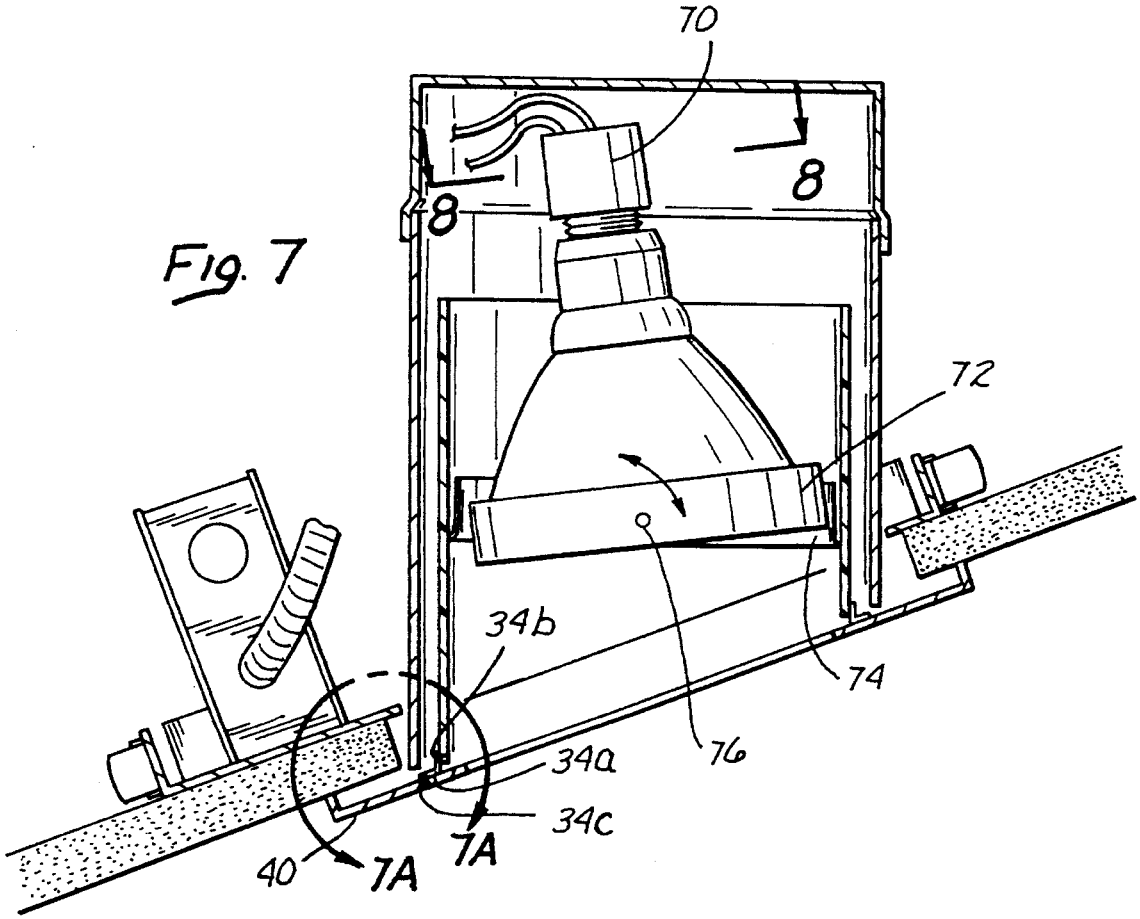
FIG. 7 is a view similar to FIGS. 2 and 4 showing the components of FIG. 6 assembled and installed in a sloping ceiling.
Figure 8:
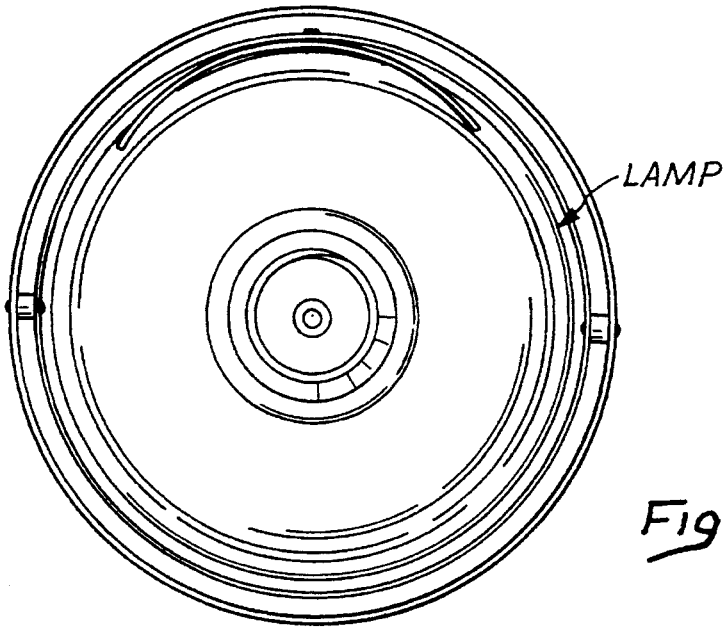
FIG. 8 is a section taken along the line 8—8 of FIG. 7.

In the embodiment of FIGS. 6, 7 and 8 the lamp base 70 is left unsupported in the manner shown in the FIGS. 1 and 2 embodiments, the pivoting support being accomplished by providing an inner mounting ring 72 which is pivotally mounted within an outer mounting ring 74 by means of elements 76 which project from the outer ring 74 radially inwardly through the inner ring 72.

It may thus be seen that the concept of the present invention is adapted for numerous applications to provide not only easy installation or retrofitting of a lamp fixture for a sloped ceiling, but also one where the direction of a lamp's illumination may be varied to satisfy to a degree not heretofore achieved with the lighting requirements in a room having a sloped ceiling.

I claim:

1. A light fixture for mounting in a recess in a sloped planar ceiling above which is a plenum, said recess being defined by the ceiling an outer cylindrical housing extending up from the sloped ceiling into the plenum, said outer cylindrical housing having an upper end and a lower end, and a cylindrical upper portion closed at the upper end of said housing, and a lower cylindrical portion terminating in the lower end which is angled with respect to the axis of the outer cylindrical housing to conform with the slope of the ceiling, said upper portion of the outer cylindrical housing enclosing power carrying electrical wiring, said fixture comprising:

an inner cylindrical housing conforming to the shape of the outer housing, said inner housing being of a lesser altitude and lesser diameter than, and disposed coaxially within, the outer housing, said inner housing being open at both its upper and lower ends;

resilient means interposed between said inner housing and said outer housing, to removably support said inner housing coaxially within the outer housing, with the lower end of the inner housing being formed and disposed to conform with the slope of the ceiling, a lamp and a receptacle to receive and support said lamp, said receptacle being connected to said electrical wiring, means to support and pivotally hold the receptacle in a disposition to direct the lamp toward the lower end of the inner housing, said means to support and pivotally comprising a pair of rigid elements pivotally secured to, and projecting oppositely from, the wall of the inner housing along a chord line and secured to the receptacle, whereby the downward orientation of the lamp within the inner housing may be varied in relation to the axis of the inner housing.

2. A light fixture for mounting in a recess in a sloped planar ceiling as described in claim 1, wherein the pair of rigid elements is pivotally connected to the receptacle by an annular member and adapted to be pivoted to change the direction of the receptacle in relation to the axis of the inner housing.

3. A light fixture for mounting in a recess in a sloped planar ceiling as described in claim 1, wherein the chord along which the pair of elements are projected is a diameter of a circle made by a plane passed perpendicularly throughout the axis of the inner housing.

4. Light fixture for mounting in a recess in a sloped planar ceiling above which is a plenum, said recess being defined by the ceiling an outer cylindrical housing extending up from the sloped ceiling into the plenum, said housing having an upper end and a lower end and a cylindrical upper portion closed at a top of said housing, and a lower cylindrical portion terminating in the lower end which is angled with respect to the axis of the outer cylindrical housing to conform with the slope of the ceiling, said upper portion of the housing enclosing power carrying electrical wiring, said fixture comprising:

an inner cylindrical housing conforming to the shape of the outer housing, and disposed coaxially within the outer housing, said inner housing being of a lesser altitude and lesser diameter than, and disposed coaxially within, the outer housing, said inner housing being open at both its upper and lower ends;

resilient means interposed between said inner housing and said outer housing to removably support said inner housing coaxially within the outer housing, with the lower end of the inner housing being formed and disposed to conform with the slope of the ceiling, a trim ring having an inner margin disposed at, and covering an edge of the lower end of said inner housing, said trim ring extending radially outwardly to cover a portion of said ceiling surface surrounding said ceiling recess, said trim ring being attached to said inner housing, a lamp and a receptacle to receive said lamp, said receptacle being connected to said electrical wiring, means to support and pivotally hold the lamp in a disposition to direct the lamp toward the lower end of the inner housing, said means to support and pivotally comprising a pair of annular elements, a first annular element being fixedly secured to an inside of a wall of the inner housing and having a first predetermined inside diameter, and a second annular element being disposed coaxially within the first annular element, and of such inside diameter as to receive and hold the lamp, and having an outside diameter sufficiently less than the first predetermined diameter of inside of the first annular element to enable the second annular element to be partially tilted within the first annular element, said second annular element being pivotally attached at diametrically opposite points to the first annular element, whereby the downward orientation of the lamp within the inner housing may be varied in relation to the axis of said inner housing upon tilting the second inner annular element within the first annular element.

* * * * *